United States Patent [19]

Oh

[11] Patent Number: 4,670,729

[45] Date of Patent: Jun. 2, 1987

[54] ELECTRICAL FUSE

[75] Inventor: Seibang Oh, Elk Grove Village, Ill.

[73] Assignee: Littelfuse, Inc., Des Plaines, Ill.

[21] Appl. No.: 868,421

[22] Filed: Jun. 3, 1986

[51] Int. Cl.[4] ..... H01H 85/24; H01H 85/16

[52] U.S. Cl. ..... 337/264; 337/264; 337/255

[58] Field of Search ..... 337/255, 256, 257, 258, 337/260, 261, 262, 263, 264, 295

[56] References Cited

U.S. PATENT DOCUMENTS

| | | | |
|---|---|---|---|
| 4,394,638 | 7/1983 | Sian | 337/264 |
| 4,544,907 | 10/1985 | Takano | 337/264 |
| 4,604,602 | 8/1986 | Borzoni | 337/264 |

*Primary Examiner*—Harold Broome

*Attorney, Agent, or Firm*—Russell E. Hattis; Stephen R. Arnold

[57] ABSTRACT

An automotive blade-type fuse has an enlarged transparent extraction flange. The flange is configured as a thin-wall structure having a cavity therein running substantially its entire length. The fuse terminal blades are captively secured in a housing to extend from the bottom thereof and have narrow extensions at the outer edges of the blades which extend upwardly into the flange cavity. A fuse link extends between the blade extensions within the cavity and at a stand-off distance from the interior walls of the cavity. The fuse housing is preferably of identical half-shell construction having lengthwise-running centering ribs and associated mating recesses to facilitate assembly.

21 Claims, 12 Drawing Figures

FIG. 11
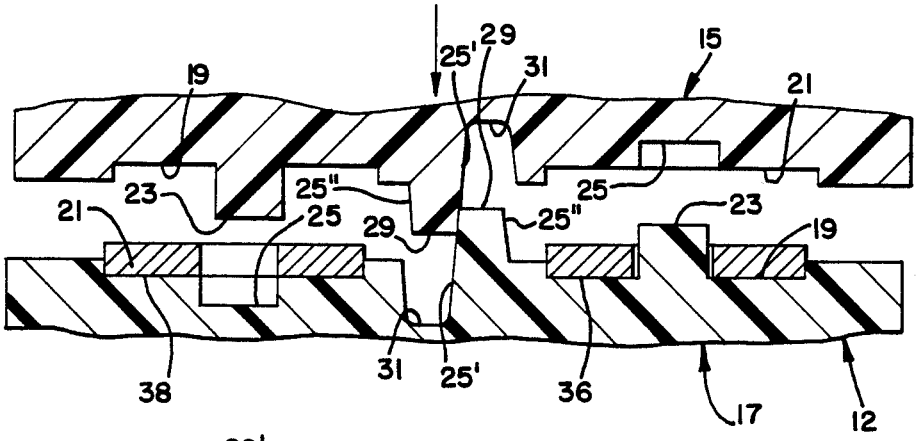
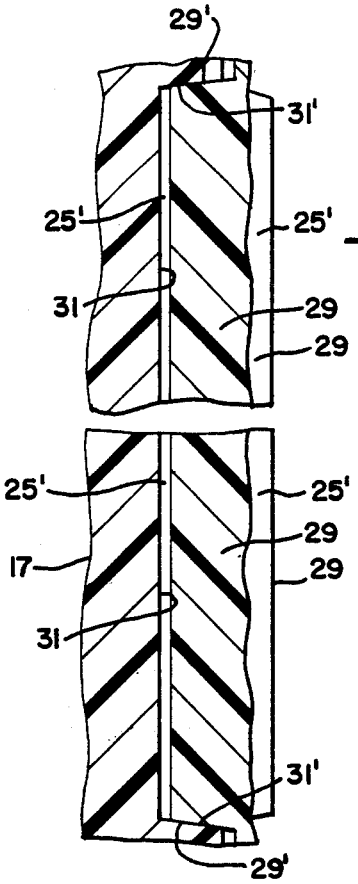
FIG. 12

ELECTRICAL FUSE

DESCRIPTION

1. TECHNICAL FIELD OF THE INVENTION

The technical field of the invention is the electrical circuit breaker art, and in particular, automotive electrical fuses, although some aspects thereof have a broader application.

2. BACKGROUND OF THE INVENTION

Along with the increasing complexity and number of electrical circuits employed in automotive installations, there has grown an increasing demand for miniature fuses to protect these installations. Because of the number of these fuses and the restricted available space to accommodate them, miniaturization of the fuses and their common fuse holder block has been a prime objective.

In particular, the currently favored automotive blade-type fuses are miniature fuses having a generally narrow housing body, from the bottom of which extend two coplanar parallel terminal blades. These fuses must meet certain standard test regulations of the Society of Automotive Engineers (SAE) and original equipment manufacturers (OEM) who specify the test conditions involved. The fuses must blow within certain minimum and maximum time limits under various test conditions. Thus, if a fuse blows in less than a given minimum time limit for the test condition involved, it is prone to premature blowing and fails the test. It was discovered that even though these fuses have passed the various SAE tests, some prematurely blowing sometimes occurs under peculiar load conditions found in some automobiles not specified so far in the test conditions. To avoid this premature blowing problem under these peculiar test conditions, the present unique "slow blow" fuse design was developed.

The blowing time of a fuse is in part governed by its mass. The larger the mass for a given resistance, the longer its blowing time will be. The resistance of a fuse link increases with its length and decreases with the cross-sectional area. Thus, a fuse link of a given resistance has its maximum mass when the fuse link has a maximum length and thickness. Despite the fact that fuse engineers had knowledge of this fact, blade fuse designers have not designed their fuses to provide a desired maximum delay to minimize premature blowing problems which can arise under the peculiar load conditions referred to.

In addition to accommodating a relatively massive fuse link, it is desired that fuse links should preferably be rigidly encased in an insulating housing which is sufficiently rugged that there is negligible likelihood that upon fuse withdrawal a blade tears loose and remains in the fuse block. Removal of a broken blade under such conditions can be extremely tedious. Finally, it is desirable that the fuse link itself be visible while the fuse is still in place in the fuse holder block, so that a blown fuse may be detected by rapid visual inspection of the entire aggregate of fuses.

Two prior art patents exemplify bladetype fuses suitable for automotive use embodying some, but not all of the abovementioned characteristics. Thus, U.S. Pat. No. 3,909,767 issued to Williamson, et al. on Sept. 30, 1975, illustrates the present commercially used automotive blade fuse. The structure will be discussed in further detail in the Description of Invention. The fuse design shown in this patent is still the most preferred fuse design for most automotive circuits. In this type of structure, all metallic portions of the fuse are preferably formed as a single piece. This piece, except for exposed end portions of the terminal blades, is enclosed by an insulating fuse housing body preferably having a head portion provided with downwardly facing gripping shoulders to facilitate removal of the fuse from a fuse block. These shoulders have been provided by a flanged head. The fuse link extending between the terminal blades has generally been centrally disposed in the portion of the housing body below the flange portion thereof. The housing body is initially cold staked into staking apertures in the terminal blades and then the staked areas are ultrasonically welded, so that the staked portions of the housing more securely anchor the metal and housing portions together.

The SAE specifications also include dimensional specifications which give the outer limitations of the dimensions of the fuse housing and terminal blades, so that automobile manufacturers can manufacture fuse holder blocks with fuse-receiving cavities which can accommodate the fuses. Therefore, while it may have been desirable to design the automobile fuses described with more massive fuse links to decrease the chances of premature blowing of the fuses, fuse designers could not increase the mass of the fuse to the desired ideal extent because of the space limitations in the fuse housing. The problem of fuse link size is particularly a problem in high current rated fuses where the fuse link requires a larger mass and must dissipate more heat than a lower current rated fuse. It is also more important in hotter higher current rated fuses to provide a significant space between the fuse link and the adjacent housing between walls to avoid damage to the housing. The space limitations in the housing of the prior fuse design did not provide the space necessary for a fuse link of the desired mass (i.e., the desired length and cross-sectional area) to overcome premature blowing problems and provide adequate spacing of the fuse link from the housing walls under the peculiar conditions referred to above.

Another automotive blade fuse which was manufactured at one time and did not meet the electrical or dimensional SAE specifications is shown in U.S. Pat. No. 4,164,726 issued to Weibe on Aug. 14, 1979. In the fuse therein disclosed, the upper ends of the fuse blades extend with their full widths up into the head portion of the housing and the fuse link is attached thereto to extend between the still closely spaced confronting margins of the blade extensions. The effective electrical length and mass of the fuse link is determined by the close inter-blade spacing at the joint where the fuse link connects thereto and so this fuse link did not have the desired mass to avoid the premature blowing problem referred to. Moreover, this fuse link was physically embedded in the plastic of the fuse housing by injection molding and did not have the desired standoff distance between the fuse and the housing material. On the other hand, the housing was made transparent, so that a blown fuse element was readily visible in the head portion of the fuse.

Both of the foregoing fuses are illustrated in the accompanying drawings, and will be further discussed in the Description of the Invention.

SUMMARY OF INVENTION

The most preferred form of the invention is an automotive fuse provided with a pair of terminal blades extending from the bottom of a unique fuse housing body. The fuse housing body has a lower main body portion having a thin dimension that fits within the dimensional restrictions of the SAE dimension specifications. A flanged portion of the housing projects above this main body portion in one and preferably both directions forwardly and rearwardly of the main body portion to enclose a relatively large chamber or cavity which can accommodate an element of substantial length and cross-sectional area which cannot be accommodated in the main body portion of the fuse. The flange portion when mounted in a fuse block of conventional design would be located above the fuse-receiving cavities therein which accommodate the narrow body portion of the fuse housing. The cavity in the flange portion of the fuse housing extends substantially the full length thereof. The upper ends of the fuse blades are cut away at the inner margins thereof to provide relatively narrow and widely spaced upwardly projecting fuse-carrying extensions which are located at opposite ends of this cavity. A fuse link of a length substantially greater than the interblade separation distance of the blades in the main body portion of the housing is attached to these widely spaced fuse-carrying extensions of the blades. The entire housing is made transparent if desired to render the fuse element readily visible at the top of the fuse housing.

In accordance with another feature of the invention, the fuse housing is constructed in a different way than are the fuse housings of the previously designed blade fuses. The housing preferably comprises a pair of preferably identical shells placed closely around the blades and spaced from the attached fuse link and secured together along their confronting faces which are in a plane parallel to or coextensive with the plane of the fuse blades. The shell halves each preferably have lay-in channels in which the blades are received, and guiding ribs and matching recesses for guiding the shells into position as they are assembled around the metal portions of the fuse. The shells further have pins which extend through apertures in the blades. The confronting faces of the peripheral housing portions are preferably ultrasonically welded together, as are the pins in their associated recesses in the shell bodies to form a secure assembly of the metal portions of the fuse and the fuse housing.

Thus, the present invention discloses an easy-to-assemble miniature fuse which has a housing which can meet SAE size restrictions while enclosing relatively massive fuse links to minimize premature blowing problems, and at the same time providing a desired spacing of the fuse link from the housing walls. Also it provides a secure retention of the fuse blades within the housing, and good visibility of the fuse link with the fuse in place.

Other aspects and features of the invention will become apparent upon making reference to the specification, claims, and drawings to follow.

DESCRIPTION OF THE DRAWINGS

FIG. 11 is an enlarged view of the portion of the fuse shown in FIG. 7 showing the engagement of alignment ribs during assembly.

FIG. 12 is a fragmentary cross-section view along the section lines 12—12 in FIG. 2.

DESCRIPTION OF THE INVENTION

Figure 8:
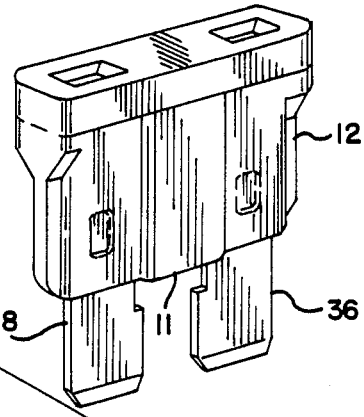
FIG. 8 PRIOR ART
FIG. 8 is a perspective view of one form of prior art automotive fuse blade.

For purposes of convenience of description, the fuse will be described and claimed when it has a vertical orientation with the terminal blades projecting downwardly from the bottom of the fuse housing. However, in actual use, the fuse can have other orientations.

FIGS. 1–7 show the most preferred form of the fuse of the present invention. The fuse 10 consists of a fuse housing having a generally narrow main body portion 12 surmounted by a generally rectangular flange portion 14. The main body portion 12 has closely spaced confronting front and rear walls 13A-13B formed by the lowermost sections of a pair of housing shells 15 and 17. Wide ribs 11 and 15 project from the central portions of the walls 13A and 13B. These ribs can serve as fuse orienting means in automatic fuse insertion equipment used by automobile manufacturers. The flange portion 14 has front and rear walls 24,26 which are located in planes forwardly and rearwardly respectively of the walls 13A and 13B of the main housing portion 12 to form gripping shoulders 28,30 to aid in removal of the fuse from the fuse block. The end faces 16,18 of the flange portion 14 are in alignment with the corresponding end faces 20,22 (FIG. 2) of the main body portion 12. In the preferred form of the invention, the flange portion 14 is symmetrically disposed with respect to the main body portion 12, but the broader aspects of the invention envisions asymmetric arrangements thereof. The flange portion 14 has a top wall 32 spanning the front wall 24 and the rear wall 26. The walls of the flange portion 14 define a sealed rectangular cavity 34. In the preferred embodiment of the invention the housing is fabricated from a transparent synthetic thermoplastic material allowing clear visibility of the interior of the cavity 34. A pair of strap-shaped planar blades 36,38 are disposed in coplanar parallel alignment within the housing with their lower ends extending from the bottom thereof and their upper ends extending into the opposite ends of the cavity 34. The blades are provided with pairs of identically centered vertically spaced anchoring apertures 54—54, the confronting faces of the shells 15 and 17 having anchoring posts 23 extending into these apertures during assembly, as will be described.

Figure 1:
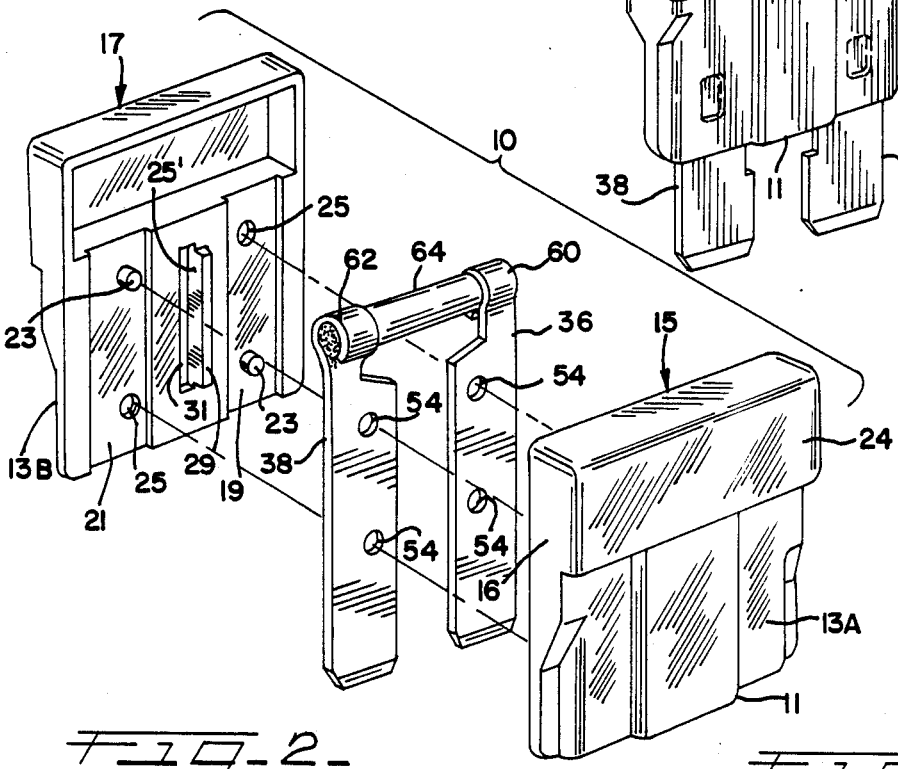
FIG. 1 is an exploded perspective view of the principal elements of the most preferred form of the fuse of the present invention prior to its assembly.
Figure 2:
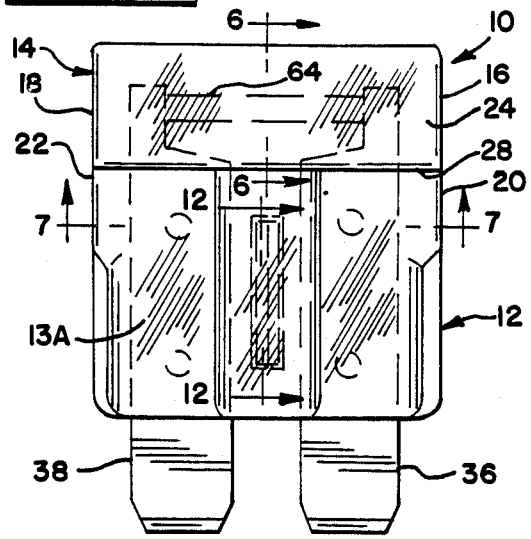
FIG. 2 is a front elevation of the assembled fuse.
Figure 3:
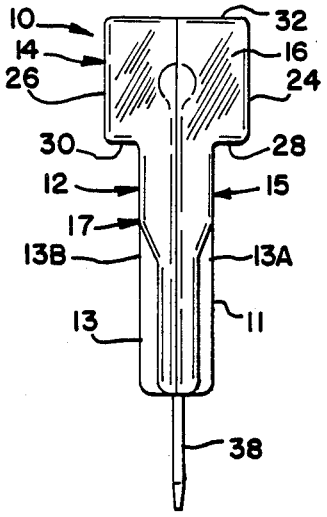
FIG. 3 is a side view of the assembled fuse.
Figure 4:
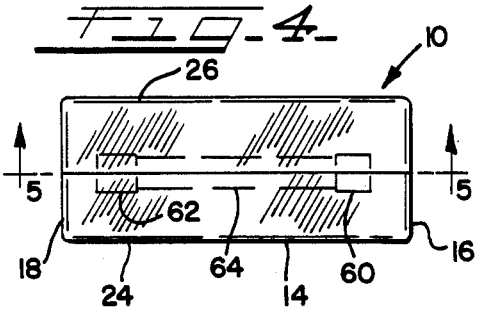
FIG. 4 is a plan view of the assembled fuse.
Figure 6:
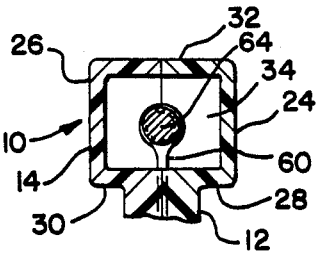
FIG. 6 is a fragmentary side cross-sectional view of the upper portion of the assembled fuse, taken along section line 6—6 in FIG. 2.

The upper ends of the blades 36,38 have relatively narrow widely spaced extensions at the outer edges or margins thereof which project into the end portions of the cavity 34 where they are spaced from the walls of the flange portion 14 of the housing. Each of these extensions 60,62 receives the ends of a fuse link 64. One particularly advantageous form of fuse link is formed by fabricating it from a piece of solder wire of appropriate specific heat, resistivity and melting point, and anchoring it within recesses in the blade extensions. To this end it is captively held between blade extensions 60,62 preferably configured as ferrule-forming extension wraps of the blades 36,38 as shown in FIG. 1. Local heating at the ends of the fuse element then causes an immediate self-soldering operation of the fuse link 64 to the blade extensions 60,62.

Considering next the assembly of the fuse, as indicated previously in the preferred form of the invention the fuse housing is formed of two identical prefabricated shells 15,17 made of a molded thermoplastic synthetic plastic material. Each forms one-half of the flange portion 14 and one-half of the main body portion 12. Each of the shells 15,17 has a pair of lengthwise running open-ended rectangular channels 19,21 dimensioned to closely accommodate in lay-in fashion the blades 36,38 at both edges thereof. The metal portions of the fuse structure form a prefabricated sub-assembly as indicated in FIG. 1 with the fuse link 64 soldered to extensions 60,62 of the terminal blades 36,38 respectively, the blades being held in coplanar arrangement.

Each of the shells 15,17 has a pair of outwardly extending anchoring posts 23,23 on the inner surface, each located at a different opposite end of the associated blade lay-in channels 19,21. The apertures 54,54 in the blades 36,38 respectively are positioned so as to receive the posts 23,23 during assembly. Confrontingly disposed recesses 25,25 in each of the housing shells 15,17 are so disposed that, when the two shells are subsequently pressed and ultrasonically welded together, each post 23 enters its associated recess 25.

Additionally, each shell is provided on its inner surface with an outwardly extending offset vertical guiding alignment rib 29 which projects outwardly further than the posts 23. Adjacent each rib is an insertion channel or recess 31 of the same size and shape as the rib of the other shell to provide a friction fit therebetween. The longitudinal side faces 25' of each rib 29 facing its adjacent channel (FIGS. 1 and 11) is an inclined extension of the inner side wall of the channel of the shell from which it extends and forms an outwardly tapering rib. The opposite side 25'' of each rib is also inclined. The opposite ends 29',29' of each rib 29 are inclined to taper the longitudinal profile of each rib and the ends 31',31' of the associated channel 31 are similarly shaped. Thus, when the two housing shells 15,17 are assembled and pressed together, a rib 29 from each housing half abuts the complementary side face 25' of the other rib and these faces and the tapered ends 29' of the ribs 29 and the complimentary shaped surfaces of the channels 31 into which the ribs 29 fit guide the shells 15,17 into proper alignment where the posts 23 enter and pass through the terminal blade apertures 25. Ultrasonic welding of the confronting faces of the shells 15,17, of the posts 23 and their associated recess walls and optionally of the ribs 29 and their associated channel walls provide a secure interconnection of all parts of the fuse.

Further, it is believed that the above-described half-shell housing assembly is generally new in the art not only as applied to fuses, but also to other parallel-lead electrical components, such as capacitors, resistors, etc. In particular, it has been found that the use of alignment ribs 29,29 and matching channels 31,31 greatly facilitates assembly of the structure by providing a rapid and convenient alignment of the two housing shells 15,17.

Figure 7:
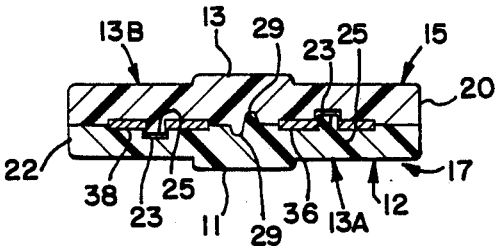
FIG. 7 is a sectional view of the fuse of the present invention, taken along section line 7—7 in FIG. 2, but prior to the ultrasonic welding of the housing body shells together.

FIG. 7 shows in horizontal cross-section the structure of FIG. 1 in assembled form and immediately prior to ultrasonic welding. It will be noted in particular that both blades 36,38 are not only anchored in position by the anchoring posts 23, but are also captively retained and positively aligned at the edges of their receiving channels 19 and 21, thereby imparting a significant degree of rigidity to the entire fuse structure.

It will be seen from the foregoing that a relatively long and relatively massive fuse link 64 can be accommodated by the fuse housing design and arrangement just described. The fuse link 64 spans a substantial entire length of the cavity 34 in the flange portion 14 of the housing. The effective electrical length and mass of a straight (or curved) fuse link between the widely spaced confronting surfaces of the blade extensions 60,62 is far greater than that of a corresponding straight (or curved) fuse link extending between the closely spaced inner margins of the portion of the blades in the main body portion 12 of the fuse housing. Also, the fuse link 64 is substantially larger in diameter than a fuse link which can be accommodated in any recess which could be formed in the thin main body portion 12, the thickness of which is limited by the SAE specifications which limit the size of the main body portion 12. The flange portion 14 is not so restricted because it will be above the automatic fuse-receiving cavities in the fuse holder which were designed to receive the old but still-to-be-used fuse version shown in FIG. 2 in circuits which do not pose a premature blowing problem.

Thus, the fuse of the present invention is capable of accepting a fuse link having a length much longer than the main interblade spacing distance and a diameter much greater than any cavity which could be designed into the narrow main body portion 12 of the housing to provide a massive fuse link giving a slow but safe slow blowing property. Also, the fuse link is disposed in a transparent chamber at the top of the fuse body and which provides a desired stand-off distance between the fuse element and the housing walls. The fuse link being at the top of the fuse can readily be viewed with the fuse inserted into a fuse block. The fuse blades are not only secured by housing pins passing through apertures therein, but are sealingly secured and captively retained along their lengths in housing receiving channels.

Figure 10:
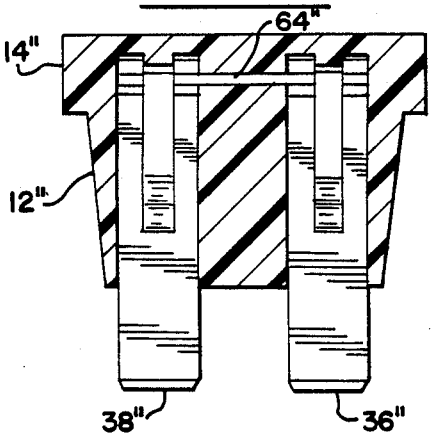
FIG. 10 PRIOR ART
FIG. 10 is a cross-sectional view of a second type of prior art fuse.
Figure 5:
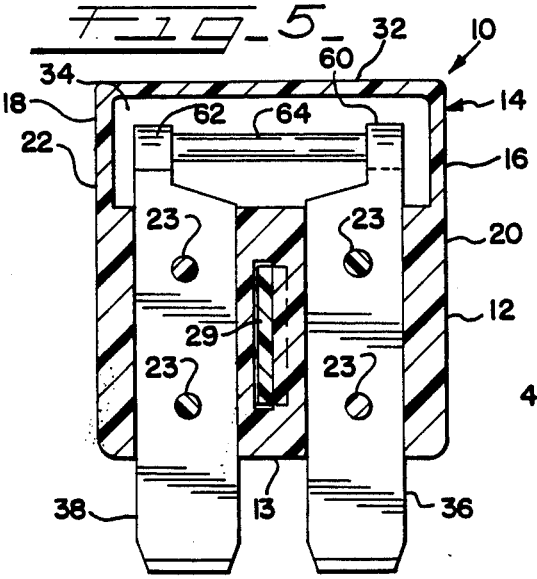
FIG. 5 is a front sectional view of the assembled fuse, taken along section line 5—5 in FIG. 4.
Figure 9:
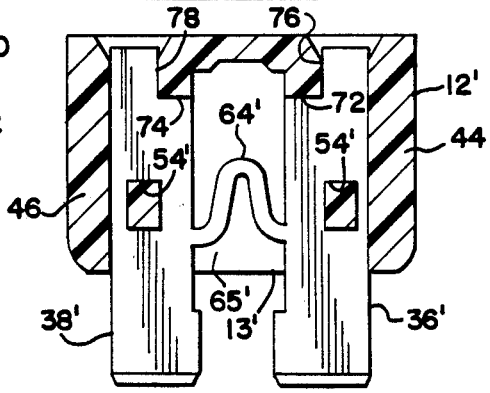
FIG. 9 PRIOR ART
FIG. 9 is a cross-sectional view of the prior art fuse of FIG. 8.

This is to be contrasted with the prior art structures shown in FIGS. 8–10. In discussing the structures, similar part designation numbers will be used where appropriate.

FIGS. 8–9 show various views of the fuse illustrated in U.S. Pat. No. 3,907,767 and briefly described in the Background of the Invention. This fuse is superior to the new fuse because it can be manufactured at a lower cost and because all metal portions thereof are formed as a single piece stamping from a string of fuse metal. In this fuse, the fuse link 64' is shown formed as a inverted U-shaped portion integral with the fuse blades 36',38' and occupying the wall space therebetween. The fuse link 64' is positioned within the central portion of a single housing piece 12' where it cannot be as easily visually inspected for a blown condition with the fuse inserted into a typical deep fuse holder socket. Clearly, there is inadequate space between the blades to accommodate a fuse of the length or diameter of the fuse link 64 shown in FIGS. 1–7. The housing 12' has an opening 65 so it can be inserted over and around the blades.

Considering the cross-section of the assembled fuse as shown in FIG. 9, it will be seen that cutouts 76,78 in the upper ends of the fuse blades 36',38' engage housing shoulders 72,74. The fuse blades 36',38' are secured by staking and ultrasonically welding the housing into fuse blade apertures 54'. A stand-off distance is provided between the fuse link 64' and the closely spaced walls of the housing 12'. The close spacing of the fuse blades and the thickness of the housing obviously do not provide space for a massive fuse link like fuse link 64' in the fuse of FIGS. 1–7.

FIG. 10 shows the fuse described in U.S. Pat. No. 4,164,726, also briefly described in the Background of the Invention. Here a fuse link 64'' is affixed to the ends of fuse blades 36'',38'' by clip-like structures. The blade and link assembly 36'',38'',64'' is held in position while a housing consisting of a body 12 and an integral flange 14'' is formed around this assembly by injection molding. As in the present invention, the fuse link 64'' is disposed within the flange portion 14'' of the housing 12''. Further, the housing may be made transparent to allow easy visual inspection of a blown fuse. However, the flange portion of this housing is not located above a main body portion which fits within the fuse block cavity of fuse blocks. Rather it is positioned to fit within such cavities when these cavities were designed to provide appreciable clearance, since the flange size exceeds the SAE size limitation specifications. Also, the flange of the fuse is much smaller than the flange of the commercial fuse of the present invention. Furthermore, the fuse link 64'' is closely encased by the housing material molded around it, so that case rupture can readily occur during a short-circuit blowout. Of most significance is that the fuse length is inefficiently utilized, since it is in electrical contact with closely spaced portions of the blades 36'',38'' so that its effective resistance and mass is only that part of the fuse link which is between the close margins of the blades. The fuse of U.S. Pat. No. 4,164,726 thus does not disclose one of the features of the present invention where the fuse link extends between narrow upstanding blade extensions like 60,62 (FIGS. 1–7) at the outer edges of the blades.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention, in appropriate instances even the specific claims involved should be construed in light of the doctrine of equivalents.

I claim:

1. An electrical fuse comprising:

an electrically insulating fuse housing including a main body portion having closely spaced generally parallel confronting major front and rear body walls and a flange portion at the top margins of said main body portion and extending generally upward therefrom, said flange portion including major front and rear flange walls, at least one of said major front and rear walls being disposed outwardly offset from its corresponding front or rear body wall, said flange portion having a cavity therein defined by interior wall surfaces of said flange portion;

a pair of conducting fuse terminals configured as generally strap-shaped blades disposed parallel and coplanarly so as to have parallel confronting proximal blade edges and mounted within said housing parallel to said front and rear body walls with said blades extending from a bottom portion of said housing, the upper ends of said blades having relatively narrow upward extensions only at the outer margins thereof which narrow extensions are located at the opposite ends of said cavity; and an elongated meltable fuse element in said cavity extending between and affixed to said narrow blade extension of said terminal blades and spaced away from said interior wall surfaces, the distance between the inner surfaces of said front and rear flange walls exceeding the maximum distance between the exterior surfaces of said front and rear body walls, at least a portion of said flange portion being sufficiently transparent to allow visual inspection of said fuse element.

2. An electrical fuse comprising:

an electrically insulating fuse housing having closely spaced generally parallel confronting major front and rear body walls;

a pair of conducting fuse terminals configured as generally strap-shaped blades disposed parallel and coplanarly so as to have parallel confronting proximal blade edges and mounted within said housing parallel to said front and rear body walls with said blades extending from a bottom portion of said housing, the upper ends of said blades having relatively narrow upward extensions only at the outer margins thereof; and an elongated meltable fuse element extending between and affixed to said narrow blade extensions of said terminal blades.

3. An electrical fuse comprising:

an electrically insulating housing having closely spaced generally parallel spaced confronting front and rear body walls;

a pair of adjacent parallel conducting fuse terminals secured within said housing parallel to said front and rear housing walls so that lower ends of said terminals extend from a bottom portion of said housing, said terminals being configured as generally strap-shaped blades disposed parallel and coplanarly so as to have parallel confronting proximal blade edges and parallel distal blade edges, said upper ends of said fuse terminal blades being configured with narrow upward extensions extending from said distal edges; and an elongated fuse element having two ends, each end being affixed to a different one of said extension portions.

4. An electrical fuse comprising:

an electrically insulating housing including a main body portion having a size to fit within the maximum permitted space requirement of a set of housing and blade size specifications, said main body portion having closely spaced generally parallel confronting major front and rear body walls and a flange portion at the top of said main body portion to be located beyond the space to be occupied by a body portion having said maximum permitted size specification, said flange portion including major front and rear flange walls, at least one of said major flange walls being disposed offset outward of the corresponding front or rear body wall, said flange portion having a cavity therein formed by interior wall surfaces of said flange portion;

a pair of parallel conducting fuse terminals mounted within said housing parallel to said front and rear body walls so that lower ends of said terminals extend from a bottom portion of said main body portion and so that upper ends of said terminals extend into said cavity; and a fuse element extending between the upper ends of said fuse terminals so as to be supported within said cavity and spaced from said interior wall surfaces of said flange portion.

5. The fuse of claim 4 wherein said fuse terminals are configured as generally strap-shaped blades and are disposed parallel and coplanarly so as to have parallel confronting proximal blade edges and parallel distal blade edges.

6. The fuse of claim 5 wherein said upper ends of said fuse terminal blades have narrow extension portions projecting upward from said distal edges, so that their confronting margins are spaced apart a much greater distance than the confronting margins of the terminal blades therebelow, said fuse element extending between said narrow extensions.

7. The fuse of claim 1 or 4 wherein the distance between the inner surfaces of said front and rear flange walls exceeds the maximum distance between the exterior surfaces of said front and rear body walls.

8. The fuse of claim 1 or 4 wherein each of said major flange walls is offset outwardly from its corresponding body wall.

9. The fuse of claims 1, 2, 3 or 4 wherein said housing is initially fabricated as a pair of front and rear shell halves subsequently secured together about said fuse element and said fuse terminals.

10. The fuse of claim 1 or 4 wherein at least a portion of said flange portion is sufficiently transparent to allow visual inspection of said fuse element.

11. In an electrical device having a pair of spaced parallel confronting coplanar strap-shaped terminal blades connected to an electric circuit element extending between confronting ends of said blades and a rigid insulating housing enclosing said terminal blades, the improvement comprising:

a pair of housing shells configured to enclose said blades and having engaging confronting inner surfaces when pressed together around said terminal blades, the inner confronting surfaces of said shells being configured to lie generally in a plane coextensive with or parallel to the plane of said terminal blades;

shell interlocking means for fixing the relative positions of said shells;

other confronting inner surfaces of said shells providing a pair of parallel blade-receiving channels which confiningly surround said terminal blades when said confronting shell inner surfaces are in contact; and anchoring means for securing each said blade against movement along its associated channel.

12. The electrical device of claim 11 wherein said anchoring means include at least one anchoring aperture in a portion of each terminal blade and blade anchoring projections on the inner surface of at least one of said shells projecting into said blade apertures.

13. The electrical device of claims 11 or 12, wherein said housing shells are identical and said anchoring means includes a pair of identically vertically spaced pairs of apertures in each terminal blade, an upper projection on the inner surface of each shell projecting into one blade-receiving channel therein and one of said terminal blade apertures, a lower projection on the inner surface of each shell projecting into the other blade-receiving channel, and another of said terminal blade apertures.

14. The electrical device of claim 11 or 12 wherein said housing shells are identical, and said shell interlocking means includes a rib projecting inwardly from the inner surface of each shell at a point between the blade-receiving channels, and an adjacent rib-receiving recess adapted to receive the rib projecting from the other shell.

15. The electrical device of claim 12 wherein said projections of each shell are welded to the material of the other shell so that the projections interlock the two shells.

16. The electrical device of claim 12 wherein the housing shells are identical, and said shell interlocking means includes a rib projecting inwardly from the inner surface of each shell a greater distance than said blade anchoring projections extend therefrom and at a point between the blade-receiving channels, and an adjacent rib-receiving recess adapted to receive the rib projecting from the other shell, one side face of each said rib being a coplanar extension of the side of the rib-receiving recess adjacent thereto, so that during assembly of said shells about said blades said ribs are brought into side engagement to position the shells relative to one another when the shells are brought together.

17. The electrical device of claim 11 wherein said shell interlocking means includes a rib projecting inwardly from the inner surface of each shell at a point between the blade-receiving channels, and a rib-receiving recess adapted to receive the rib projecting from the other shell, each rib and the associated rib-receiving recess having complimentary tapered longitudinal sides and ends which interfit and guide said shells into proper longitudinal and lateral alignment when pressed together.

18. The fuse of claims 16 wherein the side faces of said ribs are outwardly convergent, and the confronting walls of said recesses have a complementary configuration.

19. The fuse of claim 16 wherein said end faces of said ribs are outwardly convergent, and the respective confronting surfaces of said recesses have a complementary configuration.

20. The fuse of claim 16 wherein the side and end faces of said ribs are disposed to be outwardly convergent with respect to each other and the respective confronting surfaces of said recesses have a complementary configuration.

21. In an electrical device having a pair of terminals located in a given plane and connected to an electric circuit element extending therebetween, the improvement comprising: a pair of housing shells configured to enclose said electric circuit element and having engaging confronting surfaces when pressed together around said circuit element, the inner confronting surfaces of said shells being configured to lie generally in a plane coextensive with or parallel to said given plane; and shell interlocking means for fixing the relative positions of said shells, said interlocking means includes a rib projecting inwardly from the inner surface of each shell, and a rib-receiving recess adapted to receive the rib projecting from the other shell, each rib and the associated rib-receiving recess having complimentary tapered longitudinal sides and ends which interfit and guide said shells into proper longitudinal and lateral alignment when said shells are pressed together.

* * * * *